US009032766B2

(12) United States Patent
Su

(10) Patent No.: US 9,032,766 B2
(45) Date of Patent: May 19, 2015

(54) ANTI-THEFT MECHANISM FOR ELECTRONIC DEVICES

(71) Applicant: INGAMAR CO., LTD., Lugang Township, Changhua County (TW)

(72) Inventor: Jason Su, Lugang Township, Changhua County (TW)

(73) Assignee: INGAMAR CO. LTD., Changhua (TW)

( * ) Notice: Subject to any disclaimer, the term of this patent is extended or adjusted under 35 U.S.C. 154(b) by 0 days.

(21) Appl. No.: 13/677,296

(22) Filed: Nov. 14, 2012

(65) Prior Publication Data

US 2014/0130554 A1 May 15, 2014

(51) Int. Cl.
*E05B 73/00* (2006.01)

(52) U.S. Cl.
CPC ..... *E05B 73/0082* (2013.01); *E05B 73/0005* (2013.01)

(58) Field of Classification Search
USPC ..... 70/14, 15, 57, 57.1, 58
See application file for complete search history.

(56) References Cited

U.S. PATENT DOCUMENTS 5,169,114 A * 12/1992 O'Neill ..... 70/58
5,873,271 A * 2/1999 Smith ..... 70/58
6,237,375 B1 * 5/2001 Wymer ..... 70/58
6,763,690 B2 * 7/2004 Galant ..... 70/58
7,299,668 B1 * 11/2007 Lu ..... 70/58
8,191,851 B2 * 6/2012 Crown ..... 70/58
8,418,514 B1 * 4/2013 Su ..... 70/58
8,464,563 B2 * 6/2013 Perez et al. ..... 70/57.1
8,599,019 B2 * 12/2013 Nagamura et al. ..... 70/58
8,649,169 B2 * 2/2014 Kwon et al. ..... 361/679.41
8,813,528 B2 * 8/2014 Olear et al. ..... 70/14
2002/0157431 A1 * 10/2002 Lurie et al. ..... 70/58
2010/0079285 A1 * 4/2010 Fawcett et al. ..... 70/57.1
2012/0234055 A1 * 9/2012 Bland et al. ..... 70/15
2012/0317779 A1 * 12/2012 Myers et al. ..... 70/58
2013/0067967 A1 * 3/2013 Olear et al. ..... 70/18

* cited by examiner

*Primary Examiner* — Christopher Boswell
(74) *Attorney, Agent, or Firm* — Che-Yang Chen; Law Office of Michael Chen

(57) ABSTRACT

An anti-theft mechanism for electronic devices includes an upper protecting frame and a lower protecting frame. The upper and lower protecting frames of the embodiment provide protection for the 3C products, and the first and second assembling space of the upper and lower protecting frames provide adjustable dimensions to be suitable for different sizes of 3C products. The upper and lower protecting frames can further be provided with a locking mechanism to limit the movement of the positioning member after the upper and lower protecting frames being attached onto the 3C products, which prevents the upper and lower protecting frames from being removed easily. Furthermore, with the steel wire of the locking mechanism can be attached to a secured object to secure the upper and lower protecting frames.

5 Claims, 9 Drawing Sheets

ANTI-THEFT MECHANISM FOR ELECTRONIC DEVICES

BACKGROUND OF THE INVENTION

1. Field of the Invention

The present invention relates to an anti-theft mechanism, and more particularly to an anti-theft mechanism for electronic devices.

2. Description of the Related Art

With rapid development of 3C electronic products, smart phones or tablet computers are in high demand. Since these 3C electronic products are designed with high portability, they are also easy to be stolen or damaged. For example, in typical electronic shops, many different electronic products are placed on open shelves for display that brings risks of being stolen.

Therefore, it is desirable to provide an anti-theft mechanism for electronic devices to mitigate and/or obviate the aforementioned problems.

SUMMARY OF THE INVENTION

An objective of the present invention is to provide an anti-theft mechanism for electronic devices.

In order to achieve the above mentioned objective, an anti-theft mechanism for electronic devices has an upper protecting frame and a lower protecting frame. An end of the upper protecting frame provided with a first positioning portion, and the first positioning portion the first positioning portion has a first stopping wall and a first accepting space. Furthermore, an end of the first stopping wall extends to form a first securing edge. Another end of the upper protecting frame is provided with a first assembling portion. A surface of the first assembling portion is provided with a plurality of positioning slots, and at least one through aperture respectively is disposed on two sides of the positioning slot. Two sides of the first assembling portion respectively form a protruding edge. An end of the lower protecting frame is provided with a second positioning portion. The second positioning portion has a second stopping wall and a second accepting space. An end of the second stopping wall extends to form a second securing edge. Another end of the lower protecting frame is provided with a second assembling space. An inner surface of the second assembling space has a plurality of limiting slot corresponding to the plurality of positioning slots of the upper protecting frame 10. Each side of the limiting slot is respectively provided with a limiting through aperture and a corresponding positioning member. Furthermore, two sides of the assembling space respectively form engaging grooves corresponding to the first assembling portion of the upper protecting frame.

With the above mentioned structure, following benefits can be obtained: 1. The upper and lower protecting frames of the embodiment provide protection for the 3C products, and the first and second assembling space of the upper and lower protecting frames provide adjustable dimensions to be suitable for different sizes of 3C products. 2. The upper and lower protecting frames can further be provided with a locking mechanism to limit the movement of the positioning member after the upper and lower protecting frames being attached onto the 3C products, which prevents the upper and lower protecting frames from being removed easily. Furthermore, with the steel wire of the locking mechanism can be attached to a secured object to secure the upper and lower protecting frames.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
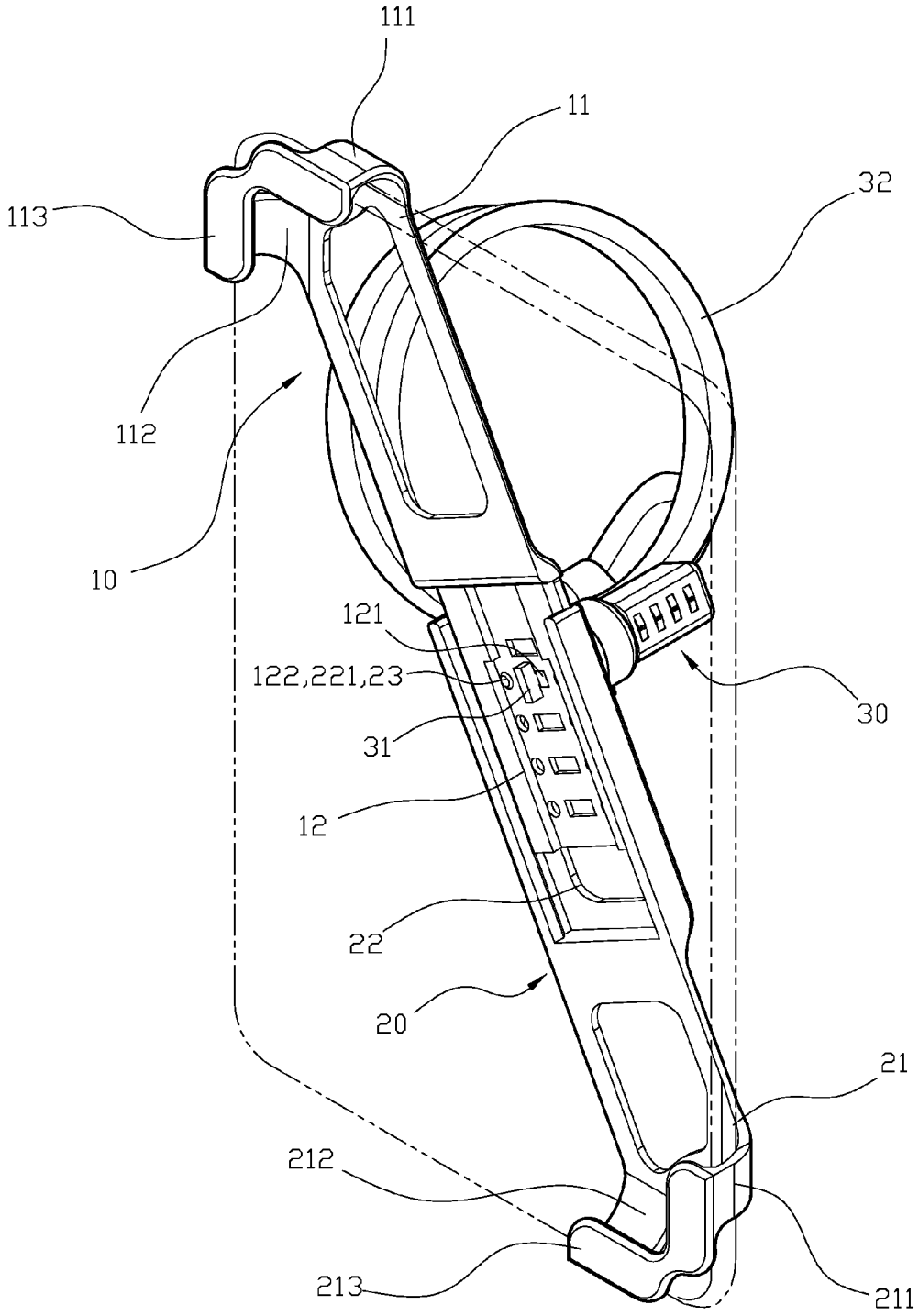
FIG. 1 is a perspective drawing of an embodiment of the present invention.
Figure 2:
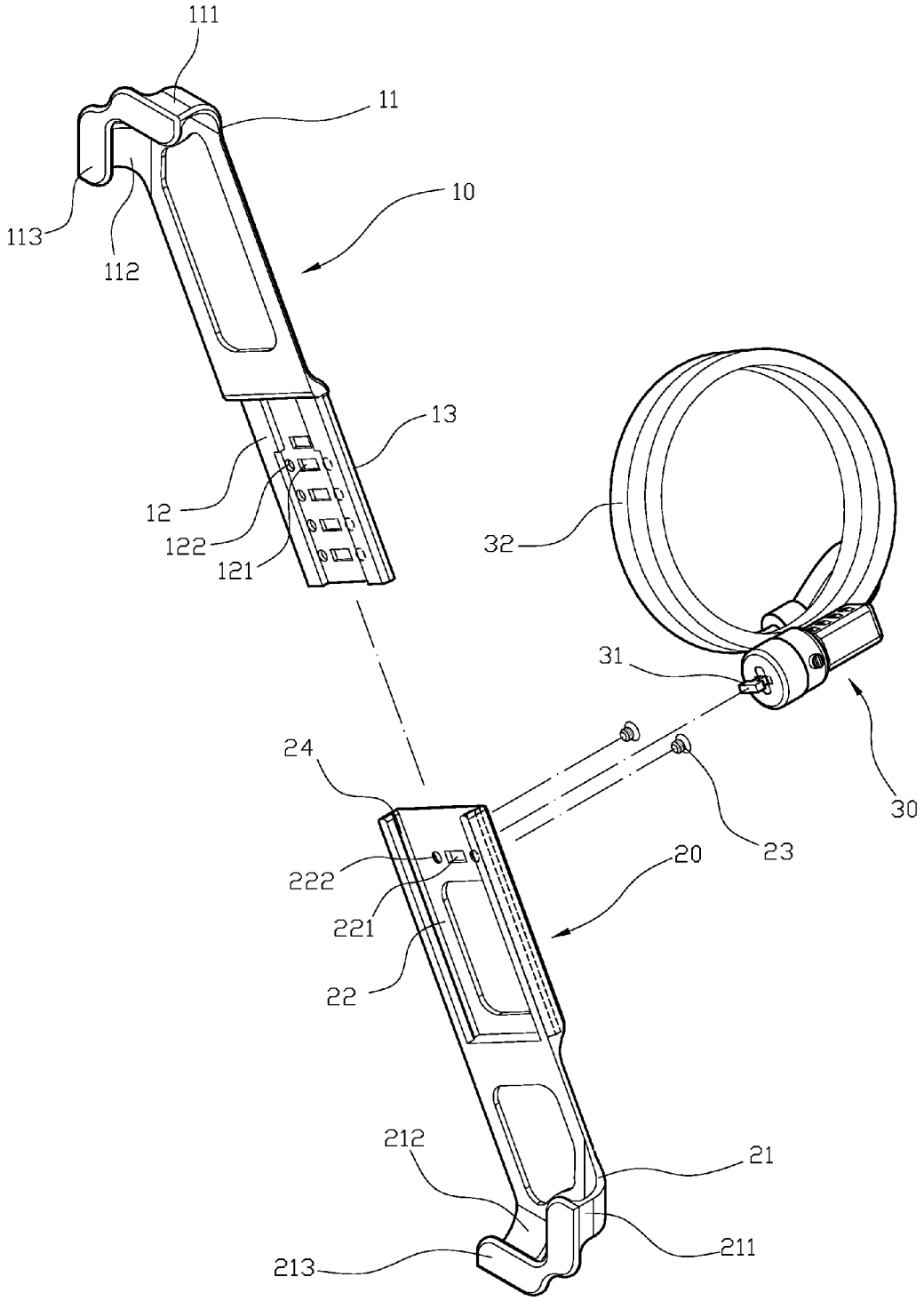
FIG. 2 is an exploded drawing of the embodiment of the present invention.

Please refer to FIG. 1, and FIG. 2. An anti-theft mechanism for electronic devices comprises an upper protecting frame 10 and a lower protecting frame 20. An end of the upper protecting frame provided with a first positioning portion 11, and the first positioning portion 11 the first positioning portion has a first stopping wall 111 and a first accepting space 112. Furthermore, an end of the first stopping wall 111 extends to form a first securing edge 113. Another end of the upper protecting frame 10 is provided with a first assembling portion 12. A surface of the first assembling portion 12 is provided with a plurality of positioning slots 121, and at least one through aperture 122 respectively is disposed on two sides of the positioning slot 121. Two sides of the first assembling portion 12 respectively form a protruding edge 13. An end of the lower protecting frame 20 is provided with a second positioning portion 21. The second positioning portion has a second stopping wall 211 and a second accepting space 212. An end of the second stopping wall 211 extends to form a second securing edge 113. Another end of the lower protecting frame 20 is provided with a second assembling space 22. An inner surface of the second assembling space 22 has a plurality of limiting slots 221 corresponding to the plurality of positioning slots 121 of the upper protecting frame 10. Each side of the limiting slot 221 is respectively provided with a limiting through aperture 222 and a corresponding positioning member 23. Furthermore, two sides of the assembling space 22 respectively form engaging grooves 24 corresponding to the first assembling portion 13 of the upper protecting frame 10.

Figure 3:
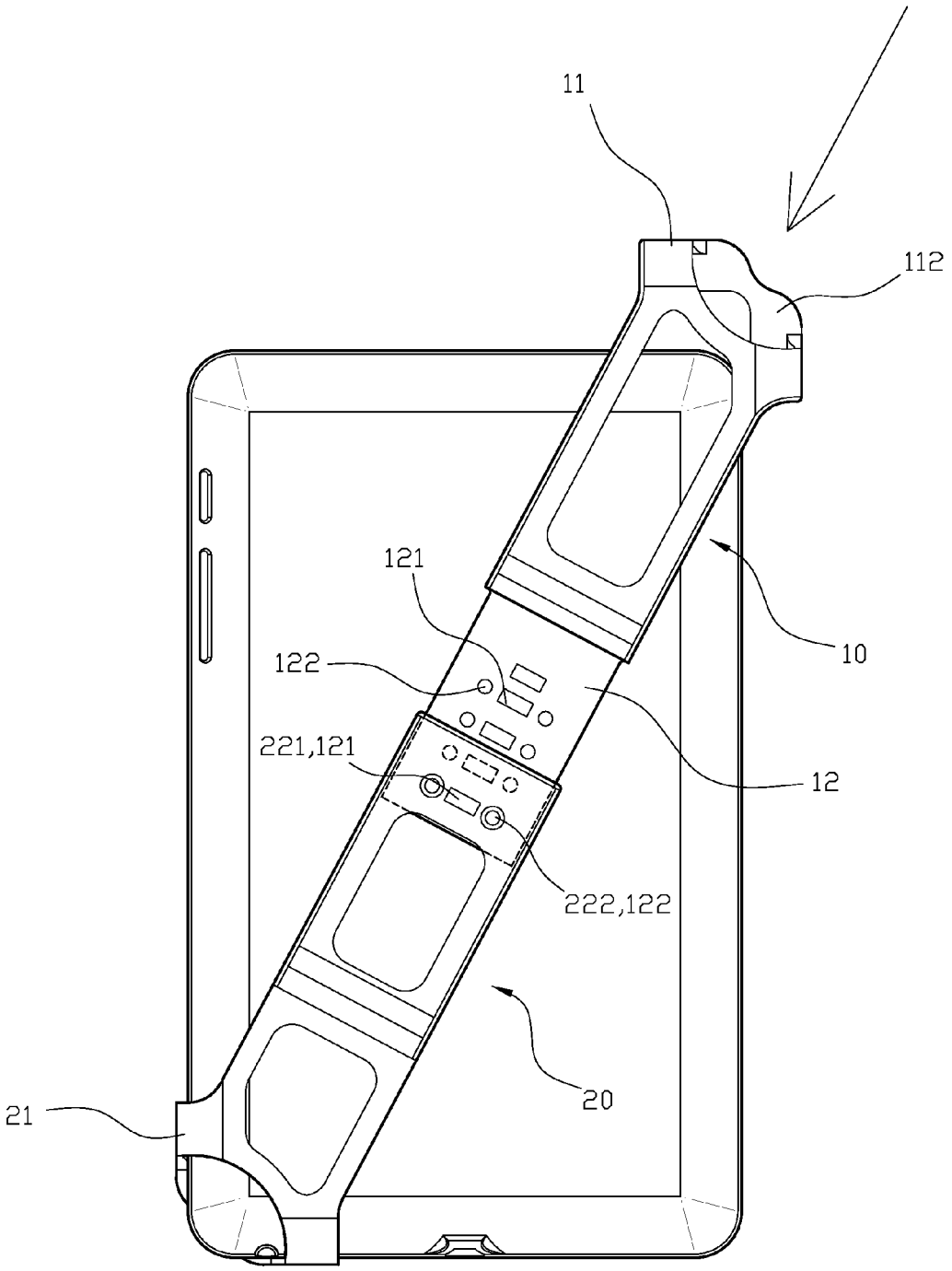
FIG. 3 is a schematic drawing of assembly movement of the embodiment of the present invention.
Figure 4:
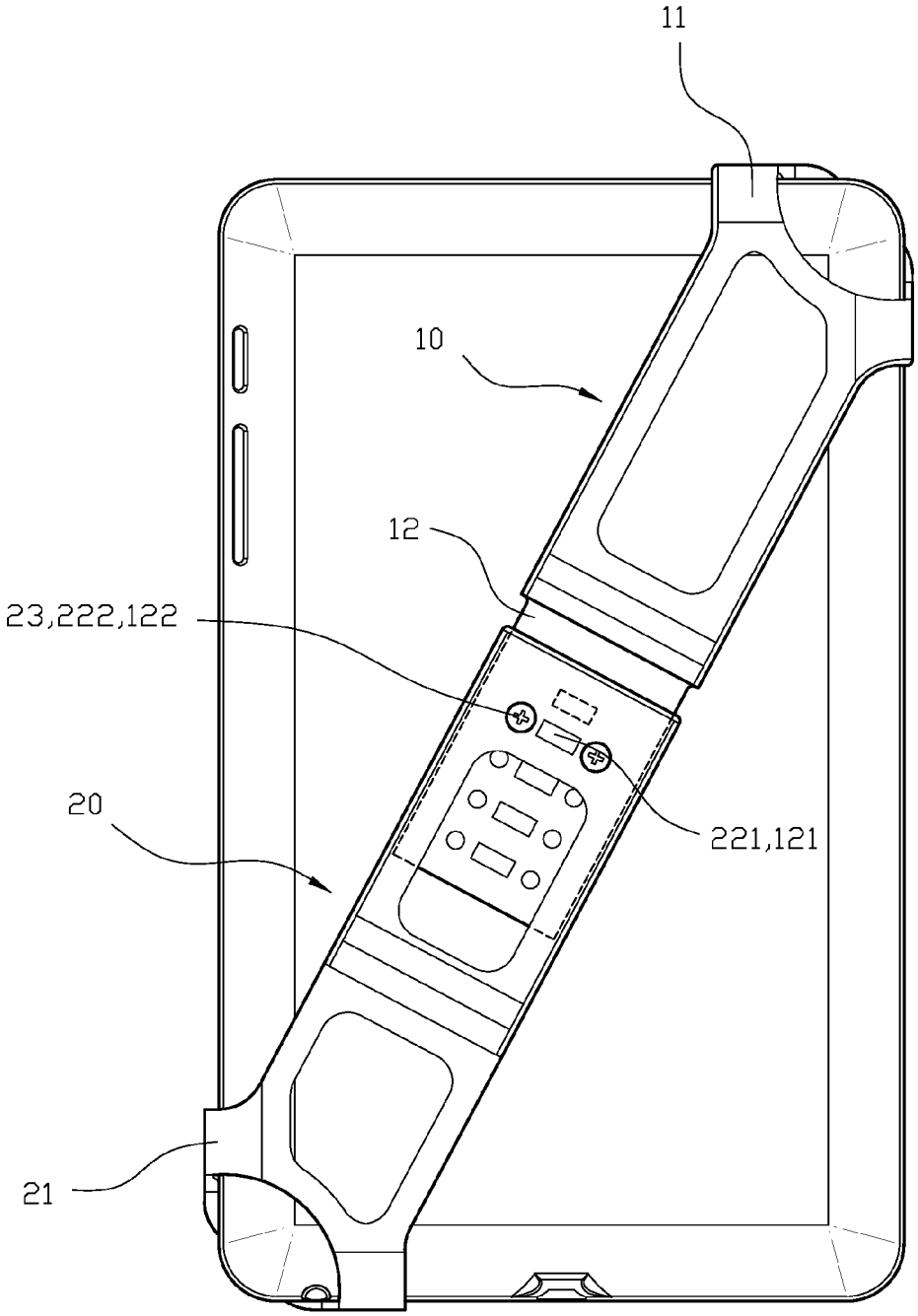
FIG. 4 is a schematic drawing of assembly status of the embodiment of the present invention.

For actual assembly and operation, please refer to FIG. 2, FIG. 3 and FIG. 4. The upper and lower protecting frames 10, 20 are attached onto a peripheral frame of the 3C product, to provide coverage and protection. The upper and lower protecting frames 10, 20 are respectively attached onto two diagonal corners of the 3C product, the first assembling portion 12 of the upper protecting frame 10 is inserted into the second assembling space 22 of the lower protecting frame 20, and the protruding edge 13 of the first assembling portion 12 and the engaging groove 24 of the second assembling space 22. Therefore, the upper and lower protecting frames 10, 20 are adjustable for different sizes of 3C products. First, the second accepting space 212 of the second positioning portion 21 of the lower protecting frames 20 is placed onto one corner of the 3C product, and the second stopping wall 211 and the second securing edge 113 both provide positioning function at this corner. Then, the first assembling portion 12 of the upper protecting frame 10 is pushed in the second assembling space 22 of the lower protecting frame 20 until lithe first accepting space 112 of the first positioning portion is placed onto another corner of the 3C product, and the first stopping wall 111 and the first securing edge 113 both provide positioning function at this corner. Therefore, the first and second positioning portions 11, 21 of the upper and lower protecting frame 10, 20 respectively cover the two diagonal corners of the 3C product. Last, the positioning member 23 is inserted through the limiting through aperture 222 of the lower protecting frame 20 and the through aperture 122 of the first assembling portion 12 to limit the movement between the upper and lower protecting frames 10, 20.

Figure 5:
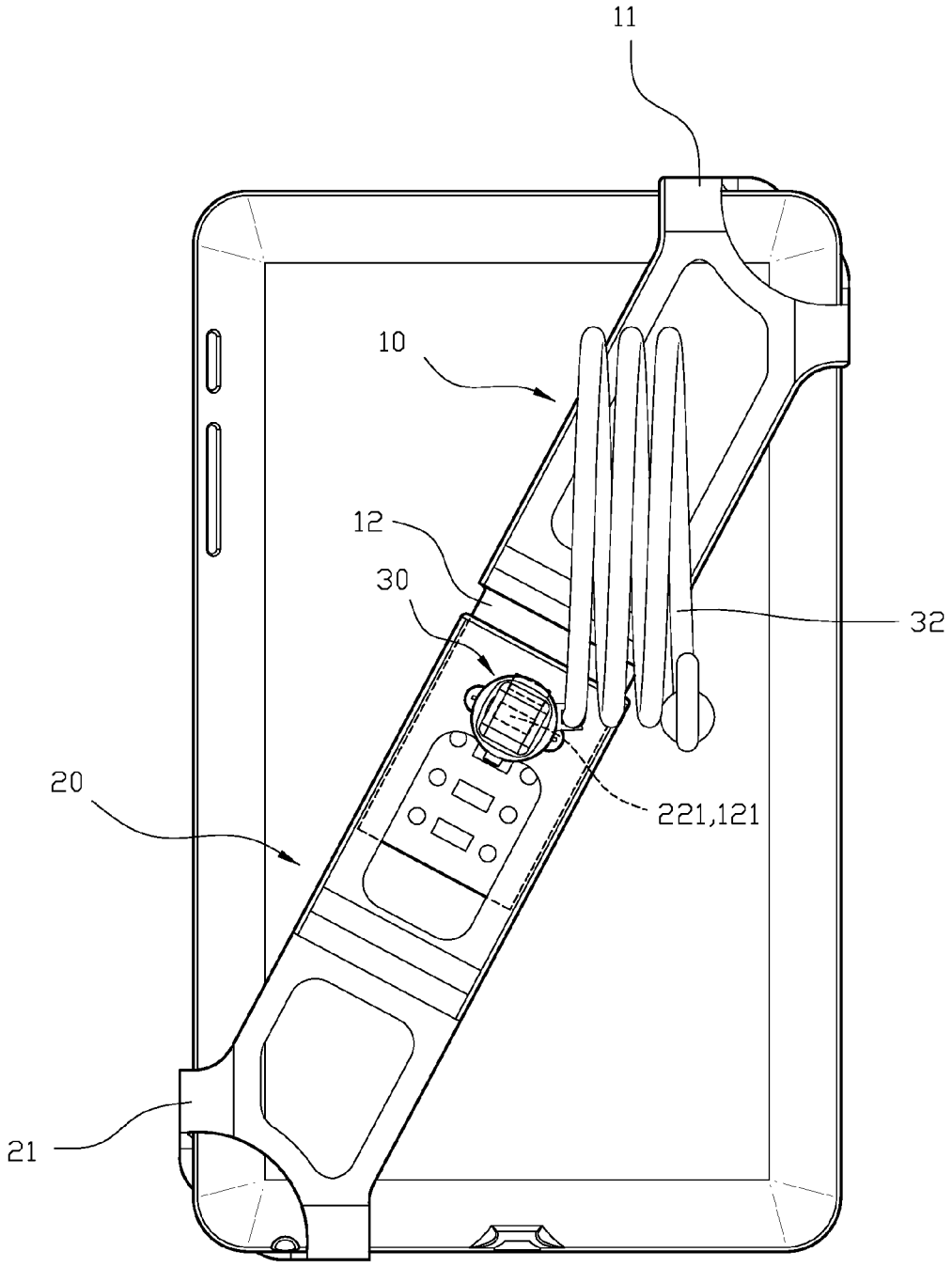
FIG. 5 is a schematic drawing of the embodiment with an external lock according to the present invention.
Figure 6:
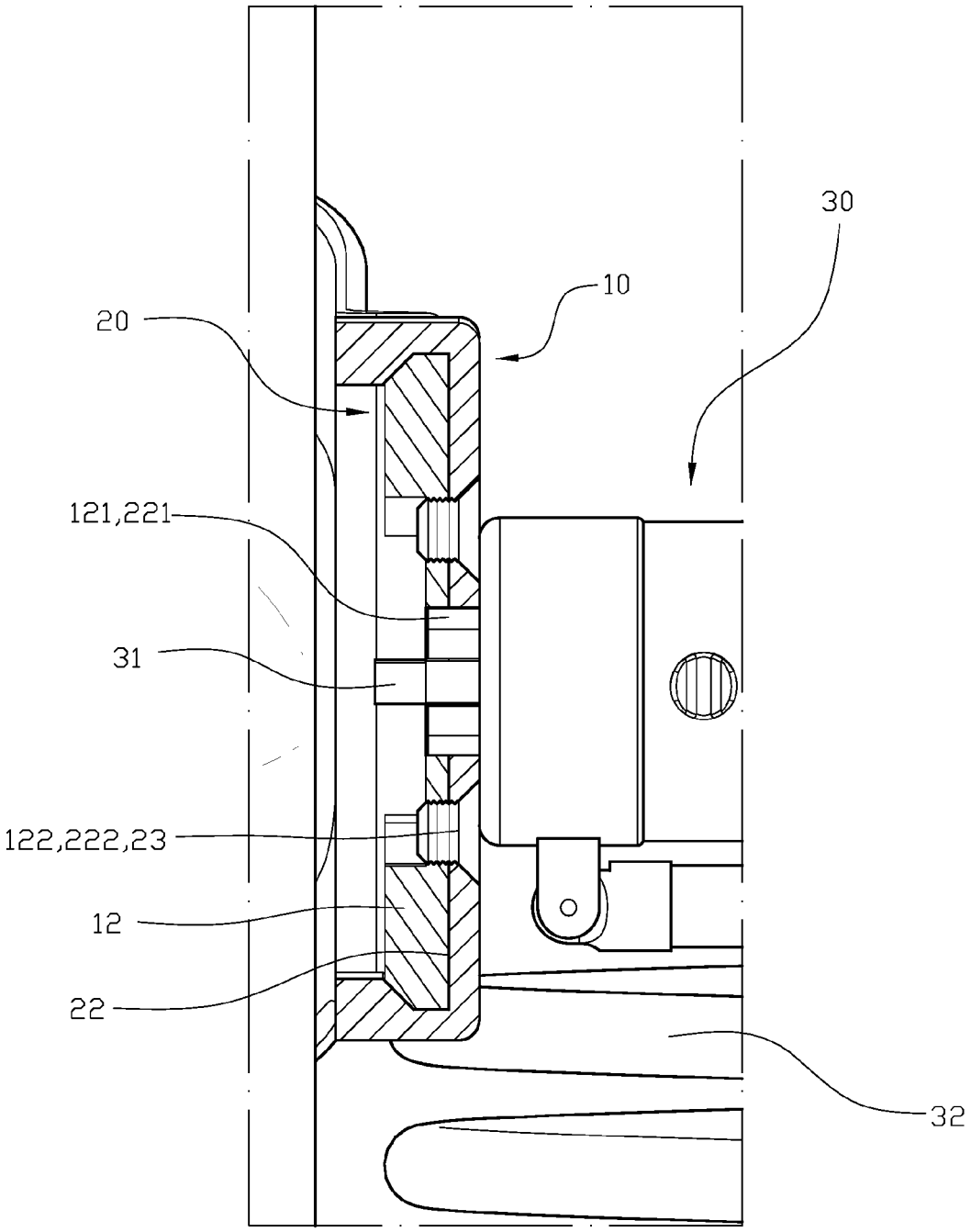
FIG. 6 is a cross-sectional drawing of the embodiment with an external lock according to the present invention.
Figure 7:
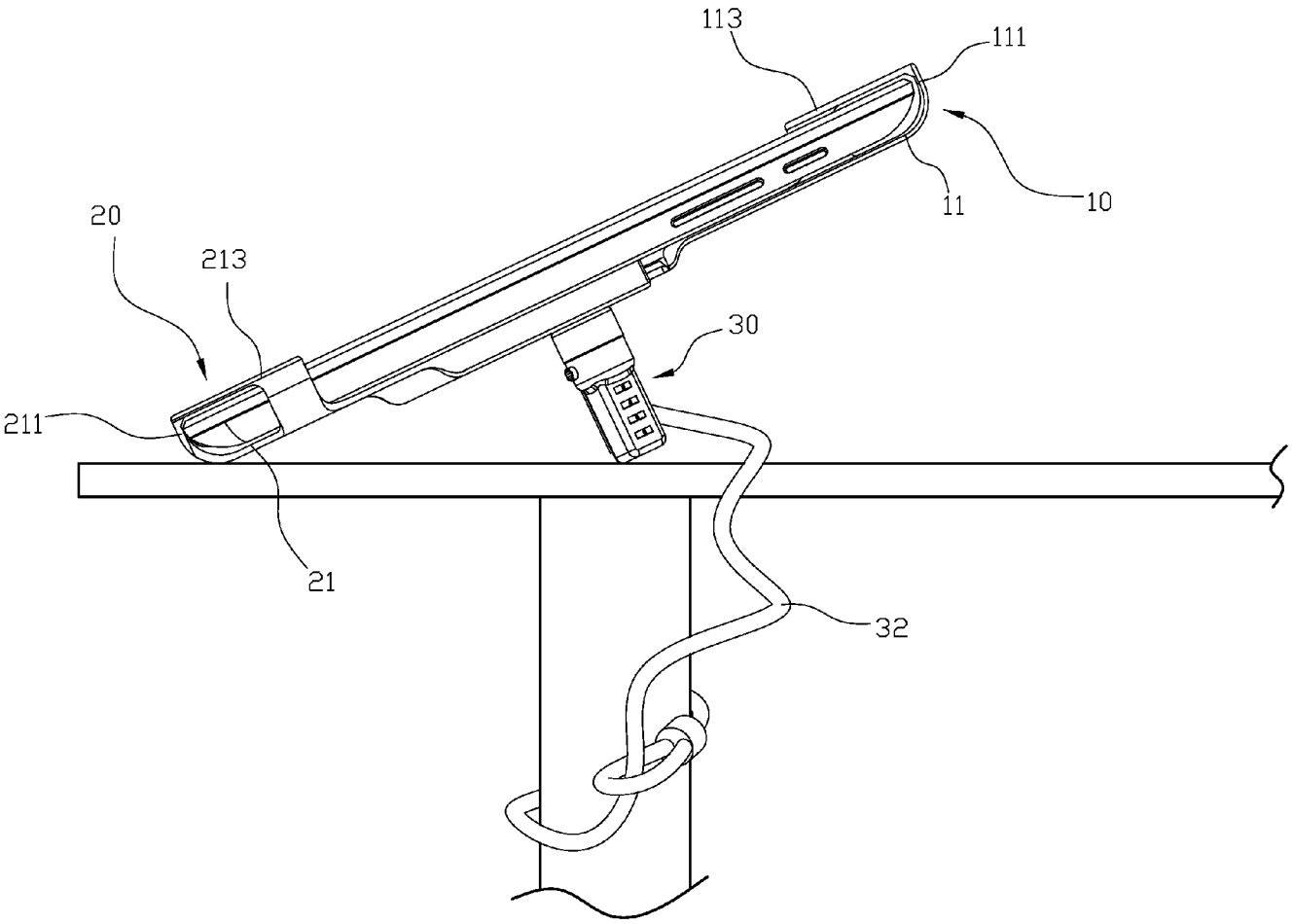
FIG. 7 is a schematic drawing of the embodiment with an external lock and a steel wire according to the present invention.

Moreover, the upper and lower protecting frames 10, 20 further comprise a locking mechanism 30. Please refer to FIG. 2 with FIG. 5 and FIG. 6. The locking mechanism 30 has a locking protrusion 31 corresponding to the positioning slots 121 and the limiting slots 221 of the upper and lower protecting frames 10, 20, such that the locking protrusion 31 of the locking mechanism 30 can be engaged with the positioning slot 121 and the limiting slot 221 to secure the upper and lower protecting frames 10, 20 together. When the locking mechanism 30 is engaged, it also blocks the positioning member 23 from the lower protecting frame 20 to prevent the positioning member 22 from being disassembled. Moreover, the locking mechanism 30 is provided with a steel wire 32, as shown in FIG. 7, such that the steel wire 32 is capable of providing security for the 3C products.

Figure 8:
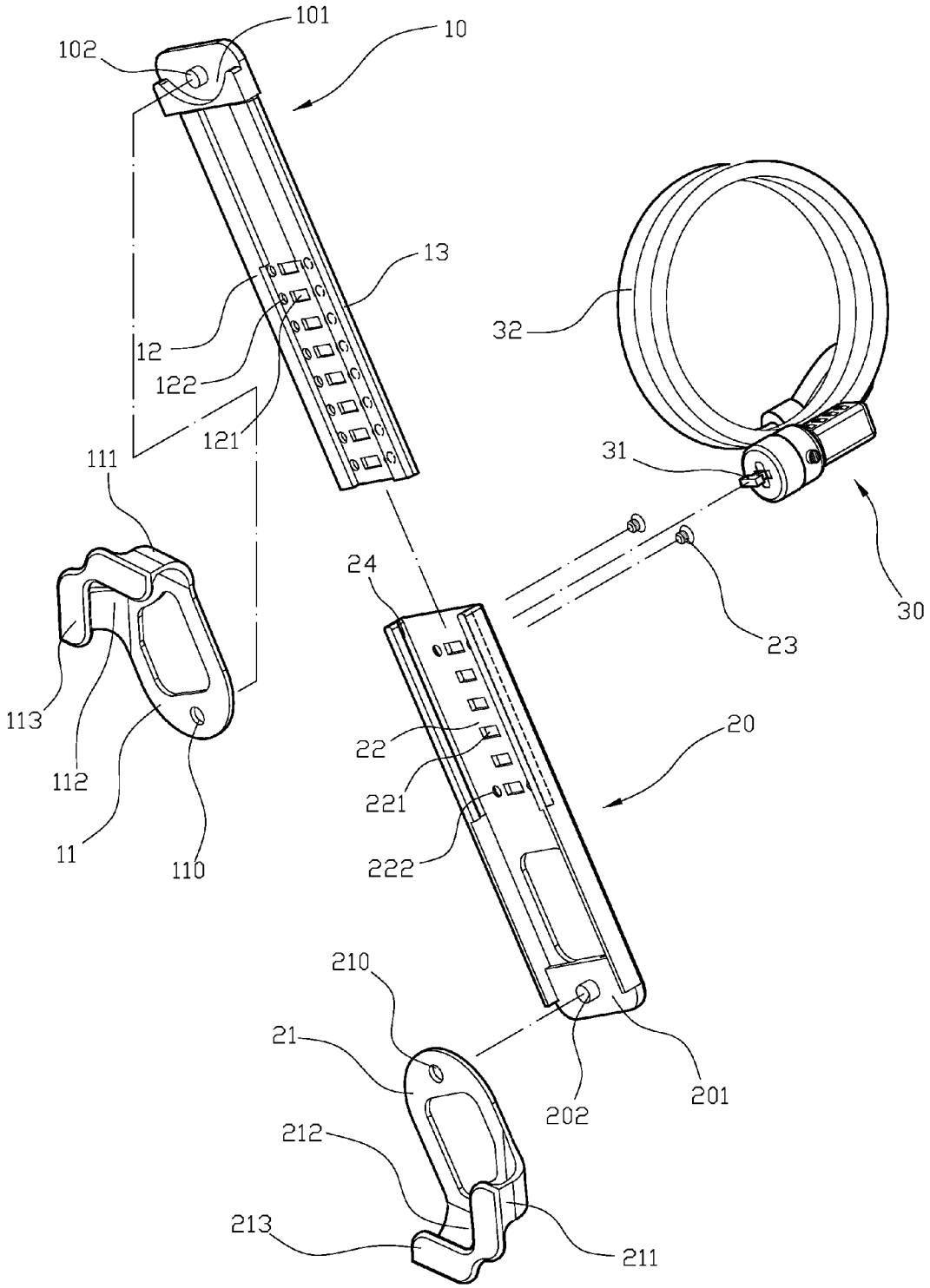
FIG. 8 shows another embodiment of the present invention.
Figure 9:
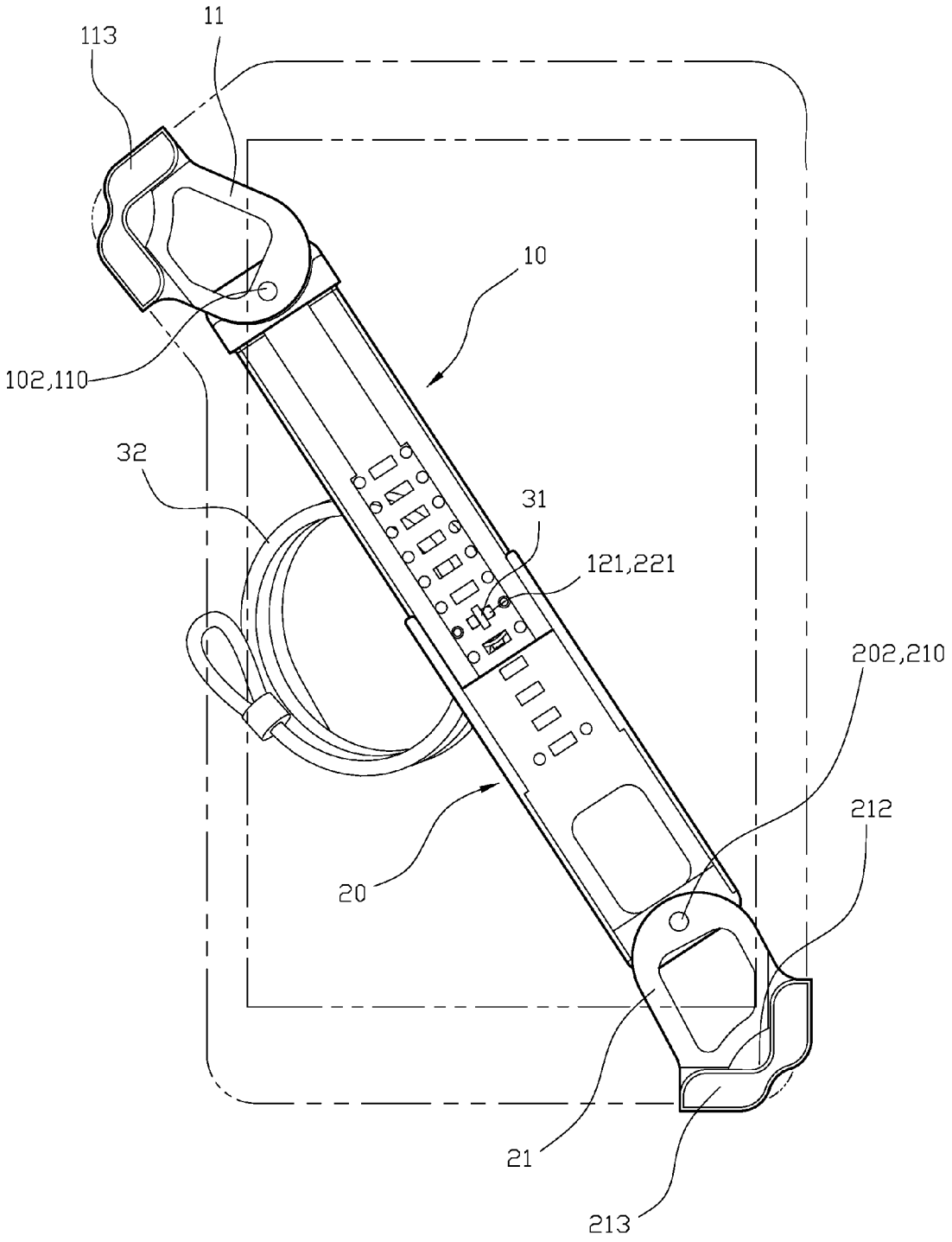
FIG. 9 is a schematic drawing of operation of another embodiment of the present invention.

For another embodiment of the present invention, please refer to FIG. 8 and FIG. 9 again. The first and second positioning portions 11, 21 of the upper and lower protecting frame 10, 20 are pivoted together. An engaging space 101, 201 and a pivoting axle are 102, 202 are respectively provided at an end of the upper and lower protecting frames 10, 20, and the first and second positioning portions 11, 21 respectively have a pivoting aperture 110, 210 corresponding to the pivoting axle 102, 202 such that the first and second positioning portion 11, 21 utilize the pivoting apertures 110, 210 to be attached onto the pivoting axles 102, 202.

With the above mentioned structure, following benefits can be obtained: 1. The upper and lower protecting frames 10, 20 of the embodiment provide protection for the 3C products, and the first and second assembling space 12, 22 of the upper and lower protecting frames 10, 20 provide adjustable dimensions to be suitable for different sizes of 3C products. 2. The upper and lower protecting frames 10, 20 can further be provided with a locking mechanism 30 to limit the movement of the positioning member 23 after the upper and lower protecting frames 10, 20 being attached onto the 3C products, which prevents the upper and lower protecting frames 10, 20 from being removed easily. Furthermore, with the steel wire 32 of the locking mechanism 30 can be attached to a secured object to secure the upper and lower protecting frames 10, 20.

Although the present invention has been explained in relation to its preferred embodiment, it is to be understood that many other possible modifications and variations can be made without departing from the spirit and scope of the invention as hereinafter claimed.

What is claimed is:

1. An anti-theft mechanism for an electronic device having a locking condition and an unlocking condition comprising:

an upper protecting frame, an end of the upper protecting frame provided with a first positioning portion, the first positioning portion having a first stopping wall and a first accepting space, an end of the first stopping wall extending to form a first securing edge, another end of the upper protecting frame provided with a first assembling portion, a surface of the assembling portion provided with a plurality of through positioning slots, and two through apertures respectively disposed on each of two sides of each through positioning slot, two sides of the assembling portion respectively forming a protruding edge;

a lower protecting frame, an end of the lower protecting frame provided with a second positioning portion, the second positioning portion having a second stopping wall and a second accepting space, an end of the second stopping wall extending to form a second securing edge, another end of the lower protecting frame provided with an assembling space, an inner surface region of the assembling space having at least a through limiting slot positioned to align with at least one of the plurality of through positioning slots of the upper protecting frame, two sides of the through limiting slot each respectively provided with a limiting through aperture and a corresponding positioning member that passes through the limiting through aperture to engage with a corresponding through aperture in the upper protecting frame, two sides of the assembling space respectively forming engaging grooves to receive said protruding edges on both sides of the assembling portion of the upper protecting frame to engage said upper protecting frame and lower protecting frame; and a locking mechanism that is configured to be completely detachable from the upper protecting frame and the lower protecting frame in the unlocking condition, having a locking protrusion to simultaneously insert into the aligned through limiting slot and the corresponding through positioning slot and rotate to a position that intersects to both the through limiting slot and the corresponding through positioning slot in a substantially perpendicular manner to further engage with said through limiting slot and positioning slot in the locking condition, wherein the first and second positioning portions of the upper and lower protecting frames respectively cover two diagonal corners of the electronic device, and the engaged upper and lower protecting frames extends between said two diagonal corners.

2. The anti-theft mechanism for electronic devices as claimed in claim 1, wherein the locking mechanism further includes a cable.

3. The anti-theft mechanism for electronic devices as claimed in claim 1, wherein the first and second positioning portions are pivoted onto the upper and lower protecting frames.

4. The anti-theft mechanism for electronic devices as claimed in claim 3, wherein an engaging space and a pivoting axle are respectively provided at an end of the upper and lower protecting frames, and the first and second positioning portions respectively have a pivoting aperture corresponding to the pivoting axle such that the positioning portion utilizes the pivoting aperture to be attached onto the pivoting axle.

5. The anti-theft mechanism for electronic devices as claimed in claim 1, wherein when engaged with the limiting slot and the corresponding one of the positioning slots, the locking mechanism at least partially obstructs the positioning members.

* * * * *